United States Patent [19]

Chin et al.

[11] 4,032,917

[45] June 28, 1977

[54] SYNTHESIS TECHNIQUE FOR CONSTRUCTING CYLINDRICAL AND SPHERICAL SHAPED WAVE GUIDE ARRAYS TO FORM PENCIL BEAMS

[75] Inventors: Edward Chin, Rego Park, N.Y.; Leonard Schwartz, Montville, N.J.

[73] Assignee: The Singer Company, Little Falls, N.J.

[22] Filed: Aug. 21, 1975

[21] Appl. No.: 606,445

[52] U.S. Cl. ..... 343/771; 343/DIG. 2

[51] Int. Cl.[2] ..... H01Q 13/10

[58] Field of Search ..... 343/771, 768, 770, DIG. 2

[56] References Cited

UNITED STATES PATENTS

| | | | |
|---|---|---|---|
| 3,039,098 | 6/1962 | Bickmore | 343/771 |
| 3,308,467 | 3/1967 | Morrison | 343/705 |
| 3,774,222 | 11/1973 | Charlton | 343/771 |

*Primary Examiner*—Eli Lieberman

*Attorney, Agent, or Firm*—Thomas W. Kennedy

[57] ABSTRACT

A synthesis technique for constructing curved wave guide arrays in spherical sections to provide a pencil or squinted beam in a desired direction in which a plurality of slotted wave guides are bent to a radius of curvature corresponding to circles cut through a sphere and interconnected to a cap conforming thereto with each of the wave guide radiating arrays constructed as anti-phase slotted arrays with variable slot spacings, the location of the slots being dependent upon the phase correction required to generate a pencil beam.

2 Claims, 13 Drawing Figures

COMPUTED PATTERN THROUGH PRINCIPAL PLANE
$\phi = 45°$

SYNTHESIS TECHNIQUE FOR CONSTRUCTING CYLINDRICAL AND SPHERICAL SHAPED WAVE GUIDE ARRAYS TO FORM PENCIL BEAMS

BACKGROUND OF THE INVENTION

This invention relates to antennas in general and more particularly to a synthesis technique for constructing conformal antennas for radiating high frequency electromagnetic energy such that the energy is confined to form a highly directional beam.

In U.S. Pat. No. 3,721,988 a leaky wave guide planar array antenna is disclosed. This planar array produces four squinted beams used for an airborne doppler navigation system. The antenna includes a pair of slotted feed rectangular wave guides arranged to permit input energy to be applied at any one of four ports. Interconnecting and coupled to the feed wave guides by means of slots and feed wave guides is a radiating member which includes a leaky grid structure through which beam forming electromagnetic energy is radiated. In that arrangement, each port into one of the slotted arrays is used to generate a single beam. Clearly where only one or two beams are required the same technique can be used.

Although that antenna operates quite well and provides a low cost approach, it suffers from one disadvantage. The antenna is a planar array and if it were to be used as conformal antenna for use as a tracking system on missiles and artillery shells, or the like, would require a conformal radome.

Clearly in such applications i.e., for use with tracking systems on missiles and artillery shells, there is a need for a low cost conformal antenna. Direct application of the antenna disclosed in U.S. Pat. No. 3,721,988 would increase the cost because of the need for the extra conformal radome. One approach to constructing a conformal wave guide would be to use a slotted wave guide planar array such as that disclosed in U.S. Pat. No. 3,276,026. However, in using such an array curved slotted wave guides must be used. It is well known that such a curved array requires a phase synthesis technique in its design. Typically such has been accomplished in the prior art through the use of active phase elements.

Other applications require a conformal antenna array which generates a pencil beam. Again such a conformal array will have curved surfaces and will require a phase synthesis technique in designing to obtain the desired output beam. Typically such an array may be desired in a spherical configuration.

In view of this it becomes evident that there is a need for an improved technique for constructing antennas which utilize curved wave guides, in particular those using slotted wave guides which avoids the need for active phase elements thereby permitting a simpler antenna construction in a conformal configuration.

SUMMARY OF THE INVENTION

The present invention provides such a phase synthesis technique permitting the use of curved slotted wave guides in a conformal antenna without the need for active elements. This is accomplished by determining and plotting the phase along the wave guide as a function of arc length. Over this curve is superimposed the required phase differntial. The slot locations are then selected to be at the intersections of the running phase lines and the required function. In this manner the total phase correction is obtained. Particularly good correction is possible since additional 180° phase reversals may be obtained by reversing the orientation of the slot inclination.

This technique may be used along with the basic construction disclosed in prior U.S. Pat. No. 3,721,988 to provide a conformal cylindrical radiating grid. Such is disclosed in detail in copending application Ser. No. 606,657, now U.S. Pat. No. 3,995,274 filed on even date herewith and assigned to the same assignee as the present invention.

The invention specifically relates to a spherical antenna made up of an array of a plurality of slotted wave guides bent to radii of curvature corresponding to circles cut through a sphere and interconnected to form a cap conforming to a sphere and utilizing the phase synthesis technique of the present invention to develop a pencil beam obtaining phase correction without active phase elements.

DETAILED DESCRIPTION OF THE PREFERRED EMBODIMENT

Figure 1:
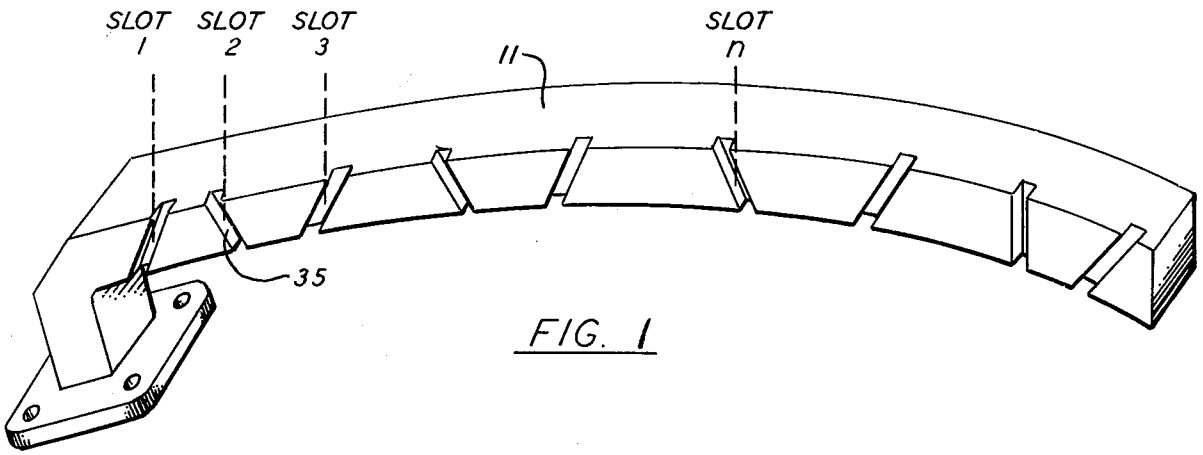
FIG. 1 is a perspective view of the wave guide of the antenna of the present invention.
Figure 2:
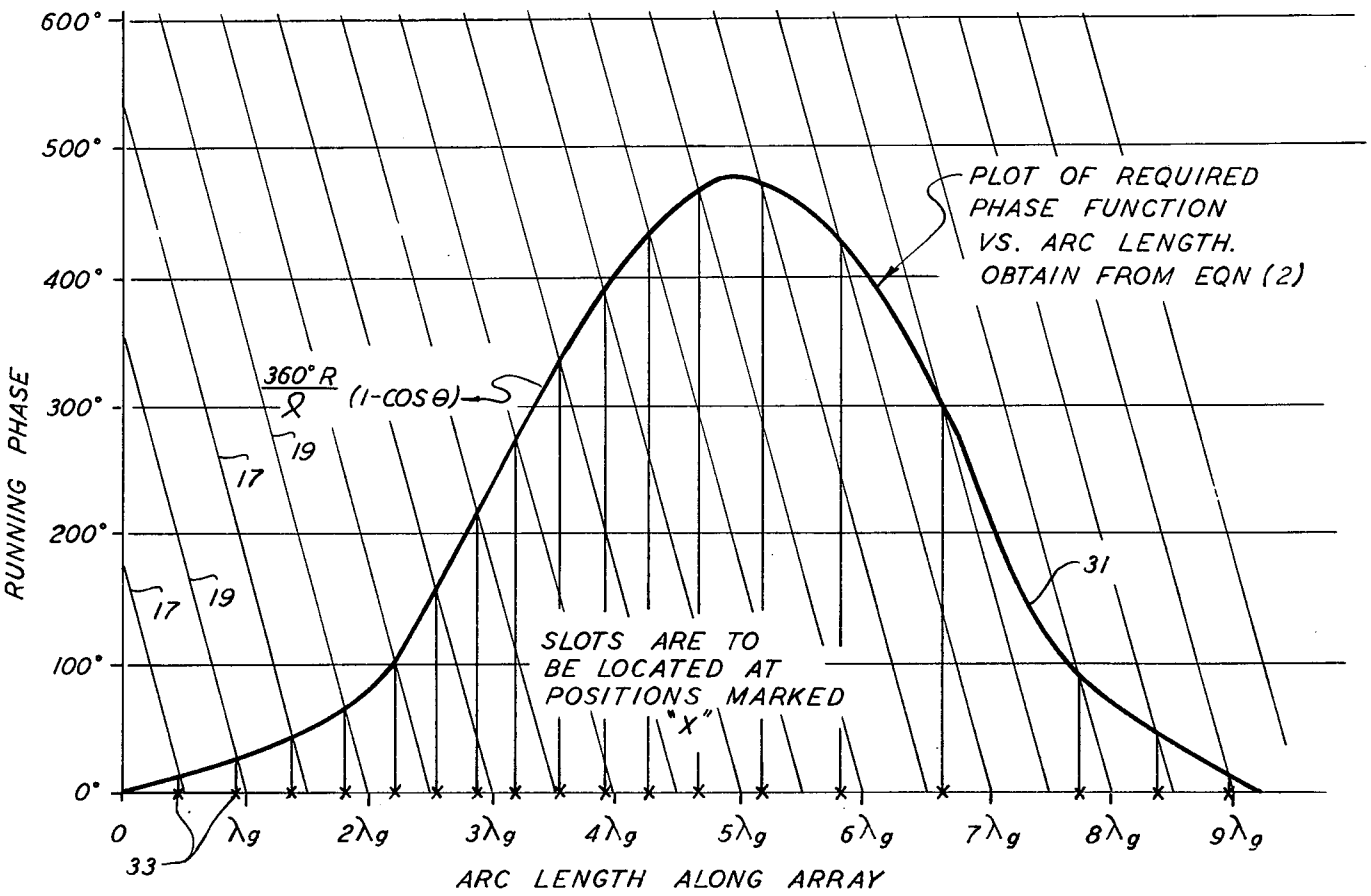
FIG. 2 is the curve of the type used in the synthesis of the wave guide of FIG. 2.

A perspective view of the type of wave guide 11 of the present invention is shown on FIG. 1 and the curve used in the synthesis of this wave guide on FIG. 2. As with any curved feed array, a phase synthesis technique is required. By using anti-phase edge cut slots, this synthesis is implemented using a variable slot spacing array. In the aforementioned U.S. patent the wave guide feed array has equal slot to slot spacings. However, such is not possible with the curved wave guide of the present invention.

It is a well known fact that antenna apertures which are circular require a phase correction in the direction of curvature equal to:

$$\delta = R(l\text{-}\cos\phi)\ (2\pi/\lambda) \qquad (1)$$

where $\lambda$ = the wavelength $R$ = the radius of curvature of the surface $\phi$ = the angular location on the circle.

Thus it is apparent that a variable phase correction is required about the circular curvature.

Because wave guide arrays can be made to be traveling wave arrays, it is possible to offset the phase differential required and given by equation (1) above. Since an additional 180° phase reversal may be obtained by reversing the orientation of the slot inclination, it is possible by minimizing the spacing between slots to more accuretely implement the phase difference given in equation (1). The manner in which this can be done is illustrated on FIG. 2. The running phase 21 as a function of arc length along the wave guide is first plotted as a plurality of parallel lines 17 and 19. As is evident from the figure, the lines 19 represent an in phase condition and are drawn from an integral wave length distance, i.e. λg, 2λg . . . along the array on the ordinate to a phase which is a multiple of 360° on the abscissa. The lines 17 represent a 180° out of phase condition and are thus drawn from half wave length positions on the ordinate to multiples of 180° on the abscissa. As is also clear from the figure, at the distance 0 along the array, the phase is 0. Basically, the parallel lines are lines which are spaced one half wave length on the ordinate and 180° on the abscissa. The lines 17 which are in each case representative of a 180° phase reversal with respect to the lines 19 represent the anti-phase slots whereas the lines 19 represent the the in-phase slots. Superimposed on this is the phase function 31 described by equation (1) above. By choosing the slot locations at the intersections of the running phase lines and the required function, total phase correction is obtained, i.e., the use of the anti-phase array permits each such intersection to be used. Thus, slots must be located at the points indicated by the X's 33 along the bottom of the graph. The antenna of FIG. 1 is shown having slots 35 on the wave guide 11 spaced in accordance with a function such as that shown on FIG. 2. The phase at any slot is equal to:

$$n = \frac{2\pi}{\lambda_g} S_\eta + (N-1)\pi \qquad (2)$$

where $S\eta$ = Arc distance of slot N measured from slot 1. 1.

Figure 3:
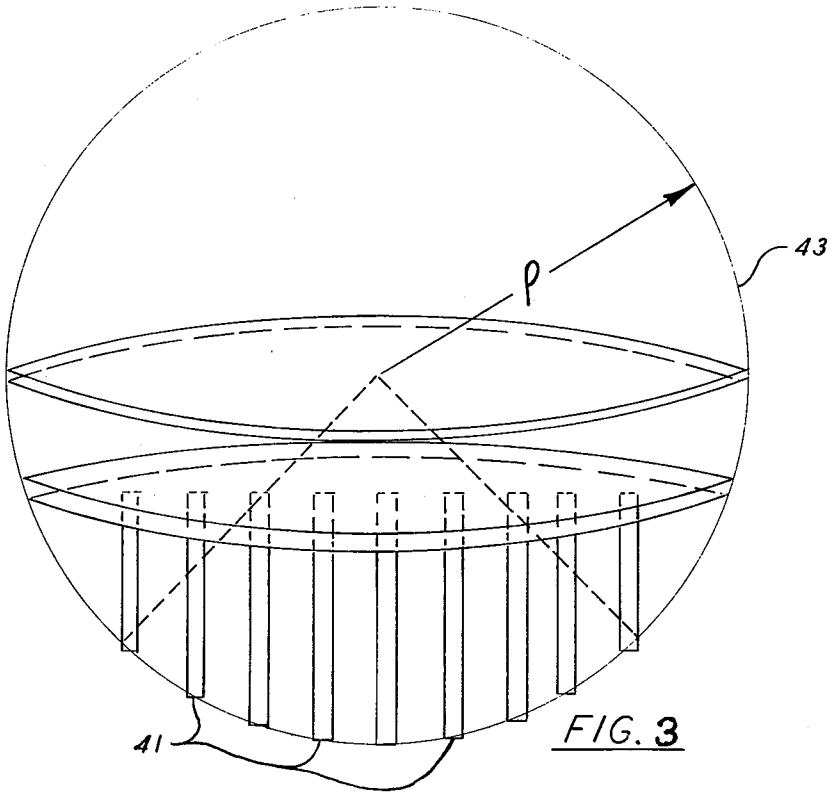
FIG. 3 is a schematic representation of a spherical antenna constructed according to the present invention.
Figure 3A:
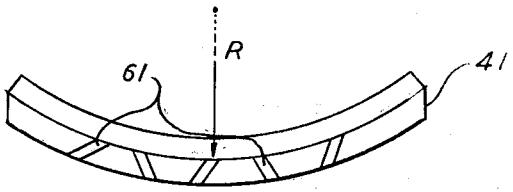
FIG. 3*a* is a perspective view of one ring array of the antenna of FIG. 3.
Figure 9D:
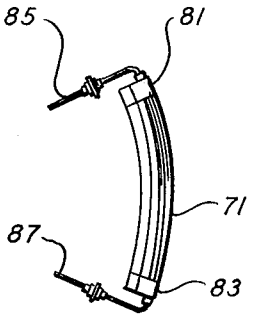
FIGS. 9*a*, *b*, *c* and *d* are views illustrating, in top and bottom, plan, elevation, and side views respectively, an antenna constructed according to the present invention but using broadwall slots.
Figure 9C:
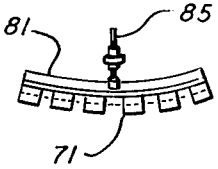
Figure 9A:
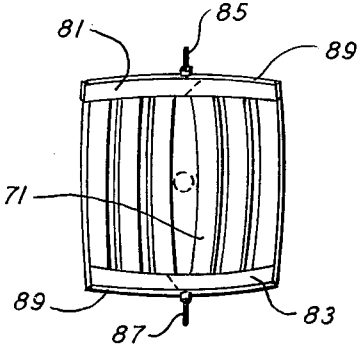
Figure 9B:
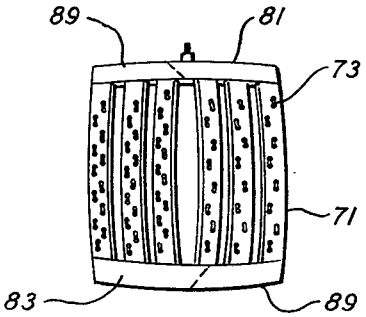

The synthesis technique of the present invention is particularly applicable to the construction of an antenna array made up of a plurality of slotted wave guides each of which is bent to a radius of curvature corresponding to a circle cut through a sphere with the wave guides interconnected to form a cap conforming to a sphere. Such a spherical array has many applications which a conformal array can generate. In such an embodiment, as in the implementation of the aforementioned copending application, no active phase shifting or amplitude controlling elements are required. This antenna is relatively simple to construct and its thickness can be made as small as the wave guide thickness. FIG. 3 is a schematic representation of the spherical antenna of the present invention with FIG. 3*a* illustrating one ring array of the spherical arrangement of FIG. 3. The spherical array comprises a plurality of arc shaped arrays 41 located along circles of a sphere 43. Each of these will be an antiphase slotted wave guide array 41 of rectangular cross section as shown on FIG. 5. As is well known in the art, ring arrays of this nature require phase compensation which can be readily determined. However, in the present case where a spherical array is provided, phase compensation must be determined in three dimensions.

Figure 4:
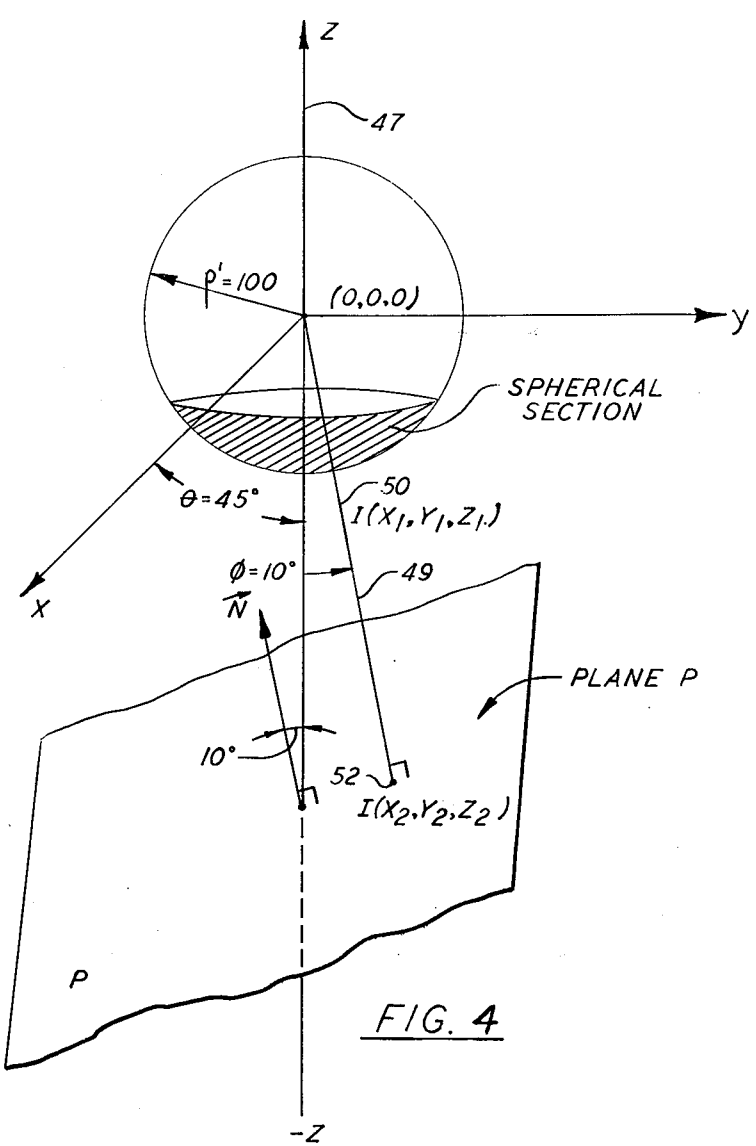
FIG. 4 is a view of a spherical section illustrating the manner of determining construction parameters for an antenna such as that of FIG. 3.

FIG. 4 illustrates a spherical section and is helpful in defining the system requirements. Consider the case where it is desired for a beam to point 10 degrees from the Zenith or Z axis 47. In such a case it is necessary that all elements located on the sphere be in phase along a phase plane which has a normal vector parallel to the beam peak.

Figure 5:
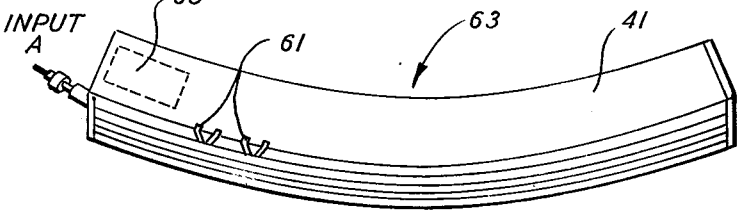
FIG. 5 is a side view of a spherical antenna constructed according to the present invention.

FIG. 5 shows a desired beam 49 squinted 10° from the Z axis and rotated 45° from the X axis. From what has been said above, an in phase condition is required at the plane P, a plane perpendicular to beam 49. Since, from spherical geometry it is known that the beam lies along the ray given by:

$$\theta_0 = 45° \text{ and } \phi_0 = 10°, \qquad (3)$$

it is possible to determine the point of intersection 50 of this line 49 and a sphere of an arbitrarily selected radius $\eta' = 100$. The point of intersection 50 can be represented by [X, Y, Z] where $$X1 = \rho' \sin\phi_0 \cos\theta_0 = 12.279$$
$$Y1 = \rho' \sin\phi_0 \sin\theta_0 = 12,279$$
$$Z1 = \rho' \cos\phi_0 = 98.481 \qquad (4)$$

From vector analysis it follows that the normal vector to the plane P is given by:

$$\vec{N} = \vec{A}_i + \vec{B}j + \vec{C}k$$

where $$A = X1$$
$$B = Y1$$
$$C = Z1 \qquad (5)$$

and where $\vec{i}, \vec{j}, \vec{k}$ are the unit direction vectors. Given the normal vector at any point of intersection, the equation of the plane can be computed from:

$$A(X-X1) + B(Y-Y1) + C(Z-Z1) = 0 \qquad (6)$$

For each point on the sphere which corresponds to a radiator location the path length to the plane P can be determined from the point (X1, Y1 and Z1) on the sphere and the equation of the plane. To do this all that is necessary is to make use of the parametric equations of the line from point 50 to the plane P using the parameter $t$ and computing the point 52 of intersection [X, Y, Z]. Then the pathlength δ can be found from:

$$\delta = \sqrt{(X-X1)^2 + (Y-Y1)^2 + (Z-Z1)^2} \qquad (7)$$

In determining these values the above equation will preferably be computed using a general purpose digital computer. A table of values obtained through such a computation is given below in table I:

Table 1

| Radiator Location On Sphere | | | | | Points Of Intersection In Plane P | | | Relative Phase |
|---|---|---|---|---|---|---|---|---|
| θ | φ | $X_1$ | $Y_1$ | $Z_1$ | $X_2$ | $Y_2$ | $Z_2$ | 2π δ/λ |
| 45 | 2.49 | .33928 | .33928 | 10.98953 | 11.27895 | 11.27895 | 98.73032 | 474.40351 |
| 45 | 4.99 | .67791 | .67791 | 10.95814 | 11.61117 | 11.61117 | 98.64747 | 474.12530 |
| 45 | 7.49 | 1.01525 | 1.01525 | 10.90589 | 11.94466 | 11.94466 | 98.56431 | 473.95816 |
| 45 | 9.99 | 1.35066 | 1.35066 | 10.83289 | 12.27878 | 12.27878 | 98.48100 | 473.90242 |
| 45 | 12.49 | 1.68350 | 1.68350 | 10.73926 | 12.61291 | 12.61291 | 98.39768 | 473.95817 |

Table 1-continued

| Radiator Location On Sphere | | | | | Points Of Intersection In Plane P | | | Relative Phase |
|---|---|---|---|---|---|---|---|---|
| $\theta$ | $\phi$ | $X_1$ | $Y_1$ | $Z_1$ | $X_2$ | $Y_2$ | $Z_2$ | $2\pi\ \delta/\lambda$ |
| 45 | 14.99 | 2.01314 | 2.01314 | 10.62518 | 12.94639 | 12.94639 | 98.31452 | 474.12530 |
| 45 | 17.49 | 2.33894 | 2.33894 | 10.49089 | 13.27861 | 13.27861 | 98.23167 | 474.40351 |
| 45 | 19.99 | 2.66029 | 2.66029 | 10.33662 | 13.60893 | 13.60893 | 98.14931 | 474.79226 |
| 45 | 22.49 | 2.97658 | 2.97658 | 10.16268 | 13.93671 | 13.93671 | 98.06757 | 475.29081 |
| 45 | 24.90 | 3.28720 | 3.28720 | 9.96939 | 14.26134 | 14.26134 | 97.98662 | 475.89822 |

The manner in which the method of the present invention is implemented will now be described. FIG. 3*a* illustrates a wave guide 41 bent along the H plane to a radius of curavture R. It has a guide wave length $\lambda_g\phi$ where:

$$\frac{1}{\lambda_g\phi} = \frac{1}{\lambda_g^2} + \frac{-1}{24R^2}\left[1 - \frac{12+\pi)^2}{2\pi^2}\ \frac{2a^2}{\lambda} + \frac{15-\pi^2}{2\pi}\ \frac{2a^4}{\lambda} + \ldots\right] \quad (9)$$

where $\lambda_g$ = guide wavelength for a rectangular waveguide. However, for $R <> 1$ it can be shown that $$\lambda_g\phi = \lambda_g \quad (10)$$

Figure 7:
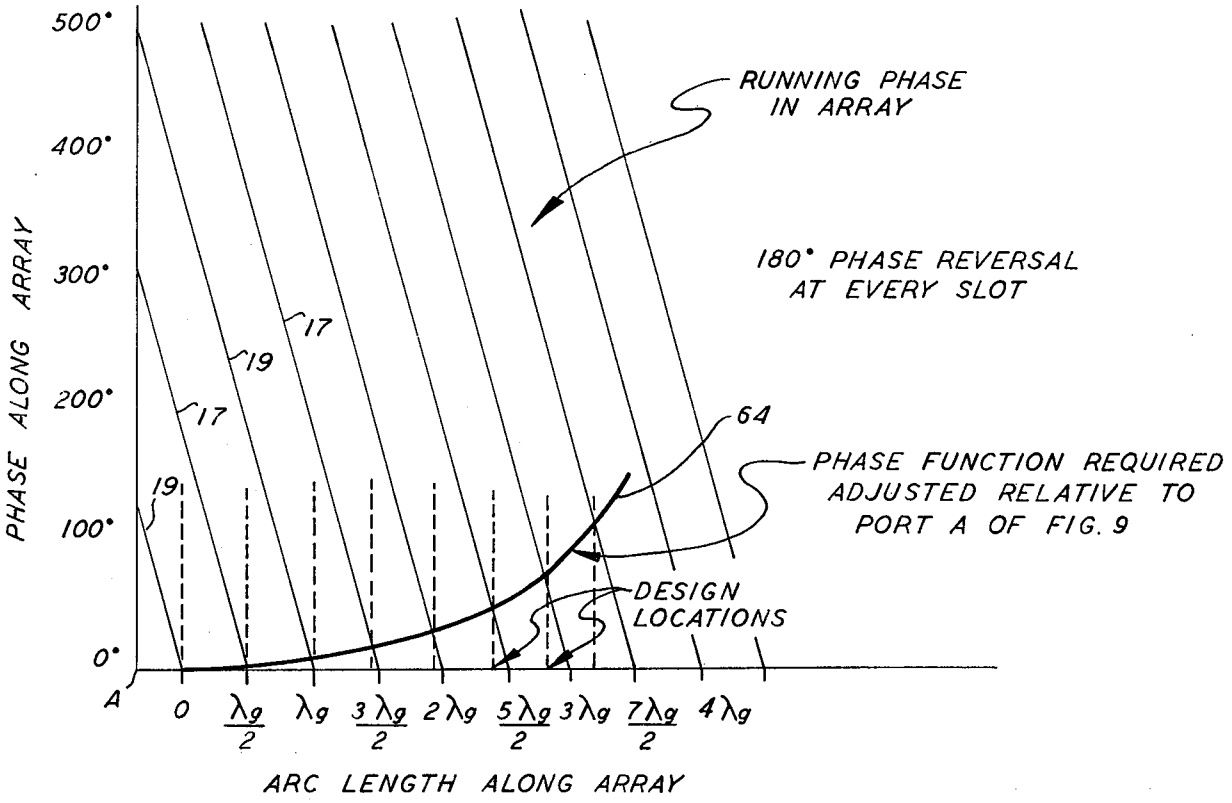
FIG. 7 is a curve used in constructing one of the elements in the array of FIG. 5.

The propagation delay in radians due to a path length $\delta_1$, is therefore $$\psi_1 = \frac{2\pi}{\lambda_g}\delta_1 \quad (11)$$

and the propagation delay due to a path length $\delta_2$ is therefore $$\psi_2 = \frac{2\pi}{\lambda_g}\delta_2 \quad (12)$$

where $\lambda$ = operating wavelength
$\lambda_g$ = guide wave length
$R$ = radius of curvature
$a$ = waveguide "$a$" dimension The curve of FIG. 7 has plotted thereon the running phase lines 17 and 19 in the array along with the required phase function 64 adjusted relative to a port at point A of FIG. 5. In this case, as illustrated on FIG. 7 because of the fact that the zero position in a wave guide 41 is displaced from the point A there will be a phase shift at that point. Thus, the first parallel line 19 from the 0 position along the arc length is drawn to a phase of approximately 120°. As with FIG. 2, the remaining lines are drawn from positions in increments of one half wave lengths along the ordinate to positions displaced by 180° along the abscissa. By selecting slots 61 at the locations where the required phase function intersects the running phase lines, the required phase function will result. Because there is a 180° phase reversal for anti-phase slotted arrays, it is possible to use the totality of information given to correct for the phase function. FIG. 3*a* illustrates a plurality of the required slots 61 cut in the wave guide 41.

Figure 6:
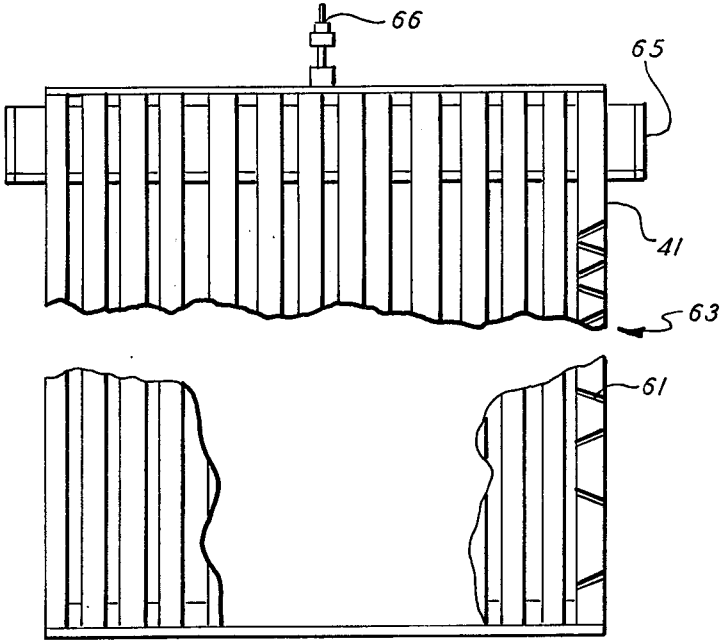
FIG. 6 is a bottom view of the array of FIG. 4.

An array 63 of wave guides 41 is illustrated on FIGS. 5 and 6 showing a side and bottom view respectively of the array. As illustrated the arrangement comprises a feed wave guide 65 fed by a coaxial feed 66 coupled to a plurality of wave guide arrays 41 arranged to form a spherical surface in the manner described above. Table II below illustrates the actual phase function of one wave guide in the synthesized array as well as the desired phase.

Table II

| Slot Location L' | Slot Number N | Phase = $-360° + \frac{L'}{\lambda_g} + (N-1)\ 180°$ SYNTHESIZED PHASE | Required Phase |
|---|---|---|---|
| 0 | 1 | 0 | 0° |
| .98λg/2 | 2 | −176.4 + (1) 180° = +3.6° | 3.0° |
| .96λg | 3 | −345.6 + (2) 180° = +14.4° | 11.0° |
| 1.45λg | 4 | −522.0 + (3) 180° = +18.0° | 17.0° |
| 1.94λg | 5 | −698.4 + (4) 180° = +21.6° | 22.0° |
| 2.62λg | 6 | −943.2 + (5) 180° = +43.2° | 41.0° |
| 2.8125λg | 7 | −1012.5 + (6) 180° = 67.5° | 70.0° |
| 3.2λg | 8 | −1152 + (7) 180° = 108° | 110.0° |

It is evident that the synthesis is quite exact.

The far field pattern of a spherical array is given in: "Conventions for the Analysis of Spherical Arrays" by Murray Hoffman, IEEE Transactions on Antennas and Propagations, p390, July 1963; "Radiation Characteristics of a Spherical Array of Polarized Elements" by Sengupta, Smith and Larson, IEEE Transactions on Antennas and Propagation, p2, January 1968; and "Equally Spaced Spherical Arrays" by Chan, Ishimaru, and Siegelmann, Radio Science, Vol, 3, p401, May 1968, as the following equation:

$$Pn = \sum_{k=1}^{q} A_k I(\xi_{kA}) \exp\left\{\frac{R\pi}{jX} R \cos \xi_{kB} - \cos \xi_{kB} + \delta_{kB}\right\}$$

where $q$ = the number of elements
$A$k = relative amplitude of the element
$I(\xi_{kA})$ = element function
R = radius of the sphere
$\xi_{kA}$ = angle between the element and a reference line
$\xi_{kB}$ = angle between beam peak and element location.

Figure 8:
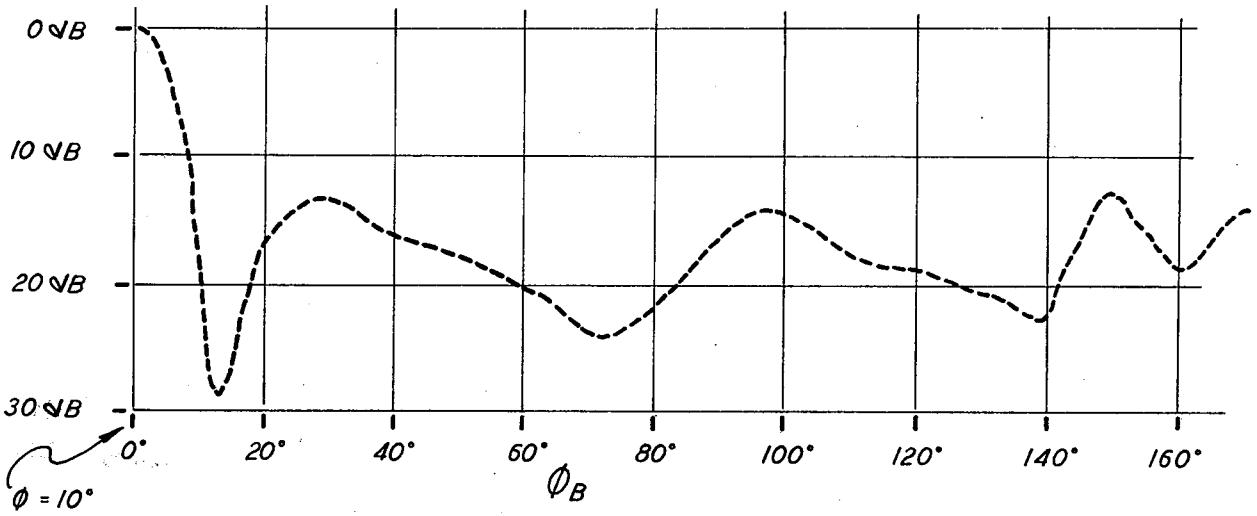
FIG. 8 is a computer derived curve illustrating the pattern through the principal plane of the antenna of FIGS. 5 and 6.

FIG. 8 illustrates a computer generated pattern based on the above equation at $\theta = 45°$. Forty illuminated radiators constructed according to the present invention were used in the computation with the radiators in the configuration illustrated by FIGS. 5 and 6.

FIGS. 9 *a*, *b* and *c* illustrate an alternate embodiment in which the individual arrays 71 are bent in the E plane rather than the H plane and broadwalls slots 73 are used. Note that, as illustrated, the arrays 71 are parallel to each other. This permits polarization to remain basically constant and as shown, horizontal. This embodiment may equally well be used in implementing the present invention. If desired the arrays can be arranged to lie along radial cuts of the sphere as shown on FIG. 3. Similarly the array of FIG. 3 may have the configuration shown on FIGS. 9 *a–c*. In the arrangement of FIGS. 9 *a–c* top and bottom feed wave guide sections 81 and 83 respectively are fed by coaxial cables 85 and 87. Each wave guide 81 and 83 has an extention 89 so that the individual wave guides 71 are fully supported. Wave guide 81 feeds the wave guides 71 to the left and wave guide 83 those to the right on FIG. 13*a*. These and other modifications may be made without departing from the spirit of the invention which is intended to be limited solely by the appended claims.

What is claimed is:

1. A method of constructing a slotted wave guide structure having unequal slot spacings such that the structure will generate a pencil beam, comrising a plurality of closely adjacent wave guide elements all of which are end fed from a common feed wave guide which is fed at a single point so as to permit the antenna to conform to a regular geometric curved surface comprising the steps of:

a. arranging the plurality of wave guide elements in a shape to cover the curved surface but so as to cover no more than one half thereof;

b. determining the required phase function of each wave guide element in the antenna to result in an in phase condition at a phase plane which has a normal vector parallel to the desired pencil beam peak;

c. plotting the phase functions so determined with respect to length along each wave guide element;

d. plotting on the same plot therewith the running phase inside said wave guide element;

e. finding the points of intersection of said running phase lines and said phase functions; and f. cutting slots at the distance along the wave guide corresponding to said points of intersection in each of said wave guide elements.

2. The method according to claim 1 wherein said curved conformal antenna is in the shape of a spherical segment extending over no more than a hemisphere.

* * * * *